US006418676B1

(12) United States Patent
Olsen et al.

(10) Patent No.: US 6,418,676 B1
(45) Date of Patent: Jul. 16, 2002

(54) MEMORIAL ACCENTS

(76) Inventors: Alice Olsen, 12 Flood Dr., Amenia, NY (US) 12501; Margaret Rieger, 27 Old Branch Rd., Wingdale, NY (US) 12594; Kenneth Buhler, 50 Trout Brook Rd., Highland Mills, NY (US) 10930; Edward Buhler, 147 Rte. 22, Pawling, NY (US) 12564; Teresa Daus, 4226 E. Weeping Willow Cir., Winter Springs, FL (US) 32708

( * ) Notice: Subject to any disclaimer, the term of this patent is extended or adjusted under 35 U.S.C. 154(b) by 0 days.

(21) Appl. No.: 09/698,719

(22) Filed: Oct. 27, 2000

(51) Int. Cl.[7] ..... E04H 13/00

(52) U.S. Cl. ..... 52/103; 40/124.5; 47/66; 248/27.8

(58) Field of Search ..... 52/103; 47/66; 248/27.8

(56) References Cited

U.S. PATENT DOCUMENTS

| | | | | | |
|---|---|---|---|---|---|
| 728,081 | A | | 5/1903 | Buchanan | |
| 745,295 | A | | 11/1903 | Raysik | |
| 873,279 | A | | 12/1907 | Weber-Illig | |
| 1,596,812 | A | * | 8/1926 | Curtis et al. | |
| RE17,487 | E | | 11/1929 | Heinz | |
| 1,907,917 | A | * | 5/1933 | White | |
| 1,982,432 | A | | 11/1934 | Hull | 47/38 |
| D110,551 | S | | 7/1938 | Smith | |
| 2,639,878 | A | | 5/1953 | Pierce | 248/151 |
| 3,511,461 | A | * | 5/1970 | Clark | 248/27.8 |
| 3,809,345 | A | * | 5/1974 | Tebbe et al. | 248/27.8 |
| 4,640,045 | A | * | 2/1987 | Nesbitt et al. | 47/66 |
| 5,687,515 | A | * | 11/1997 | Rodrigues et al. | 52/103 |

* cited by examiner

*Primary Examiner*—Carl D. Friedman
*Assistant Examiner*—Basil Katcheves
(74) *Attorney, Agent, or Firm*—Brian S. Steinberger; Law Offices of Brian S. Steinberger, PA

(57) ABSTRACT

A sturdy and lightweight decorative frame cover for upper edge corners of monument type headstones. The frame cover has an upper top frame member that pivotally is attached to a lower backing frame member with each member formed from wire type members that can be preformed into various decorative patterns such as heart shapes, and the like. The frame cover can include hooks for attaching a potholder, and a wreath thereon, and a removable flagpole holder. The frame cover can be easily affixed to the headstone by non rustable bolts that can allow the frame cover to be both affixed to the headstone and separated from the headstone by a space formed between the headstone and frame cover. Side frame members are attached to the frame cover and are adjustable to fit about different thickness headstones. The frame cover can fold up when not in use and when used supports items that include a wreath, potholder and flagpole off the ground.

19 Claims, 4 Drawing Sheets

100
110
110'
110"
112
120
122
130
133
137
140
147
149
150
151
160
161
200
210
212
213
21
220
222
223
230
233
250
251
260
261
270
271
273
279
280
281
283
289
320
330
340
350
440
450
10
11

MEMORIAL ACCENTS

This invention relates to memorials, and in particular to a decorative foldable frame that can be attached to corners of headstones for supporting flagpoles, planters, and wreaths thereon.

BACKGROUND AND PRIOR ART

The adorning of gravesites with ornamentation such as flowers, plants, wreaths, flags, etc. has long been an integral part of most cultures. Over time cemeteries become more crowded and have less space in which visitors can leave remembrances. Additionally, the sheer volume of items left at the gravesites can become unsightly. For example, loose flowers and wreaths can scatter, and flowerpots and vases can easily topple and break. Thus, routine cemetery maintenance now often requires picking up broken flowerpots, dead flowers, flags broken glass vases and broken pots, etc. The cost for these cleanups is often passed on to consumers as a part of the perpetual care for the cemeteries.

Over the years various types of patents have been proposed. However, some of the proposed solutions require large obtrusive metal mesh type devices that must cover the entire gravesite itself which would restrict ground upkeep to the grave, and must be staked into the ground at multiple locations. The ground engaging metal mesh and metal stakes can further rust and corrode over time. See for example, U.S. Pat. No. 728,081 to Buchanan; and U.S. Pat. No. 873,279 to Weber-Illig. Other proposals are temporary type stand-alone racks that are limited to only holding wreaths and the like, where the racks are not fastened down and can be easily toppled and/or stolen. See for example, U.S. Pat. No. 745,295 to Raysik; U.S. Pat. No. Re.17,487 to Meinz and U.S. Pat. No. 1,907,917 to White. Other proposals have included small devices that must be staked into the ground on or adjacent to the monument that support flower pots and flags adjacent to the ground level, and do not provide any decorative type covering for the monument itself, and do not allow for the placement of larger objects such as wreaths thereon.

Thus, there exists a need to provide a solution to the problems described above.

SUMMARY OF THE INVENTION

The first objective of the invention is to provide a frame cover that allows people to adorn a gravesite monument with wreaths, flower and plant pots and flags above the ground.

The second objective of the invention is to provide a frame cover that decorates an upper portion of a gravesite monument.

The third objective of the invention is to provide a frame cover that attaches directly to a gravesite monument and does not engage nor touch the ground.

The fourth objective of the invention is to provide a frame cover for gravesite monuments that can be folded together for ease in storage and transportation.

The fifth objective of the invention is to provide a frame cover for gravesite monuments that allows users to personally adorn the monuments.

The sixth objective of the invention is to provide a frame cover for gravesite monuments that allows users to follow cemetery rule restrictions.

The seventh objective of the invention is to provide a cover for decorating gravesite monuments that eliminates unsightly debris caused from leaving adornments on the ground.

A decorative frame cover for attachment to cemetery headstones includes an upper top frame member, a lower backing frame member pivotally attached to the upper frame member, wherein the upper frame member and the lower frame member attach about an upper edge corner portion of a headstone. The frame cover can be affixed to a headstone by screw type bolts that pass through the frame members and have ends that abut against the headstone and also form a space between the frame members and the headstone so that the frame members do not directly touch the headstone. The frame members can be formed from wire type strands such as cold rolled steel, and the like, that can be pre-shaped into various decorative patterns that include curves, hearts, rectangles, triangles, circles, curves, and customized shapes, and the like. Side members can be attached to the upper top frame member and the lower back frame member. Fasteners allow the side members to adjust to different thicknesses of headstones. The cover frame can include a detachable potholder for supporting planters, and flowers, and the like, as well as a detachable flagpole holder, and hooks for other items such as wreaths, that all can be supported securely above ground level. When the frame cover is not being used, and/or is stored and/or being transported, the side frame members can be detached from the frame cover and the upper frame member can be folded over the lower frame member so that all the frame members can be stacked together on top of one another.

The invention can fit on the right and/or left sides of a headstone as both a decorative and functional addition to the headstone, where items such as flags, pots, wreaths, and the like, are securely and safely supported above ground level.

Further objects and advantages of this invention will be apparent from the following detailed description of a presently preferred embodiment which is illustrated schematically in the accompanying drawings.

BRIEF DESCRIPTION OF THE FIGURES

FIG. 7 shows the frame cover of FIG. 2 affixed about a corner of a headstone.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 2:
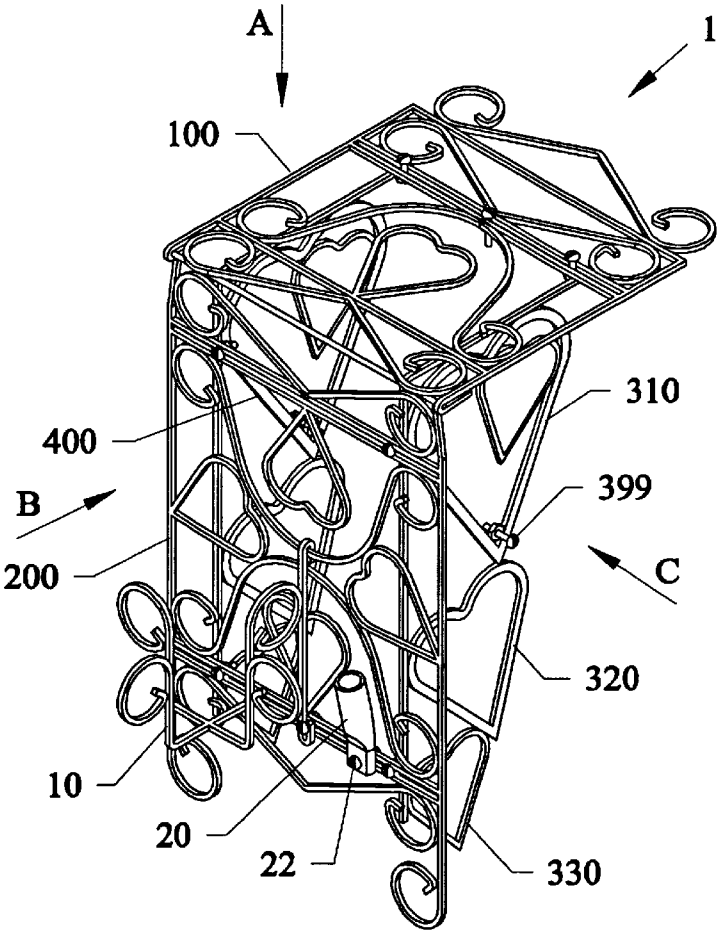
FIG. 2 is a view of FIG. 1 with both the pot and flagpole holders attached to the frame cover.
Figure 1:
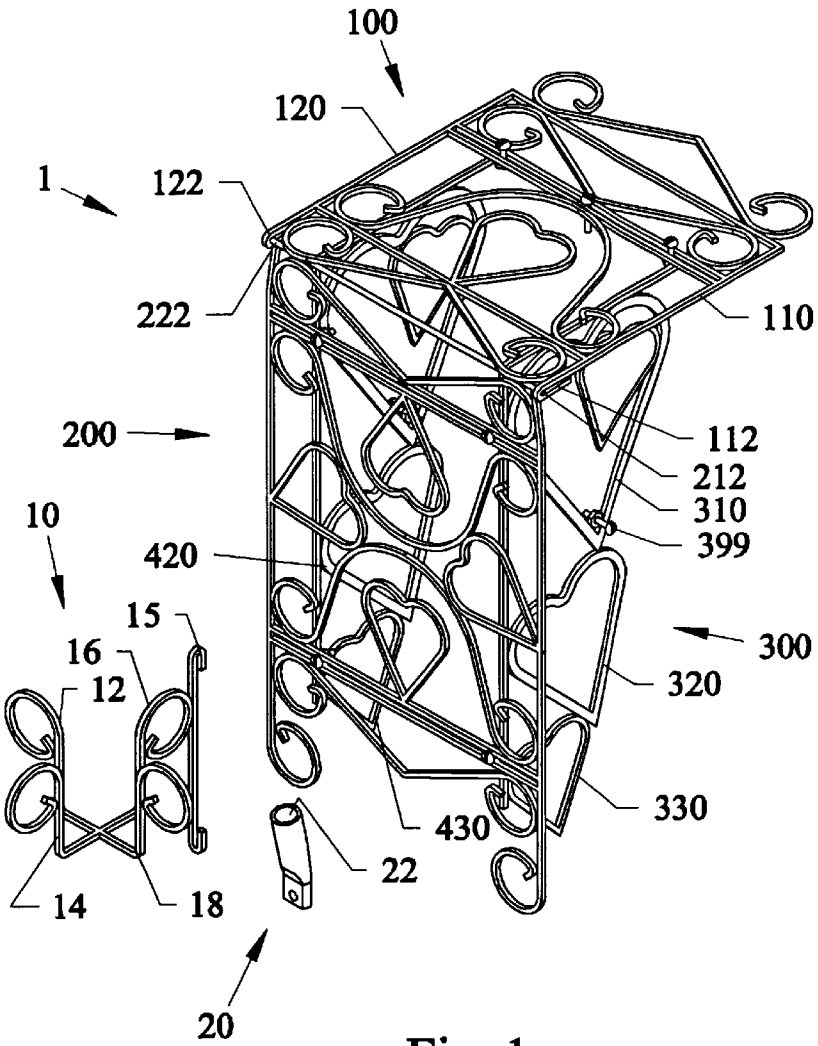
FIG. 1 is a perspective view of a pot holder and flagpole holder detached from the frame cover.
Figures 3A, 3B, 4A, 4B, 5:
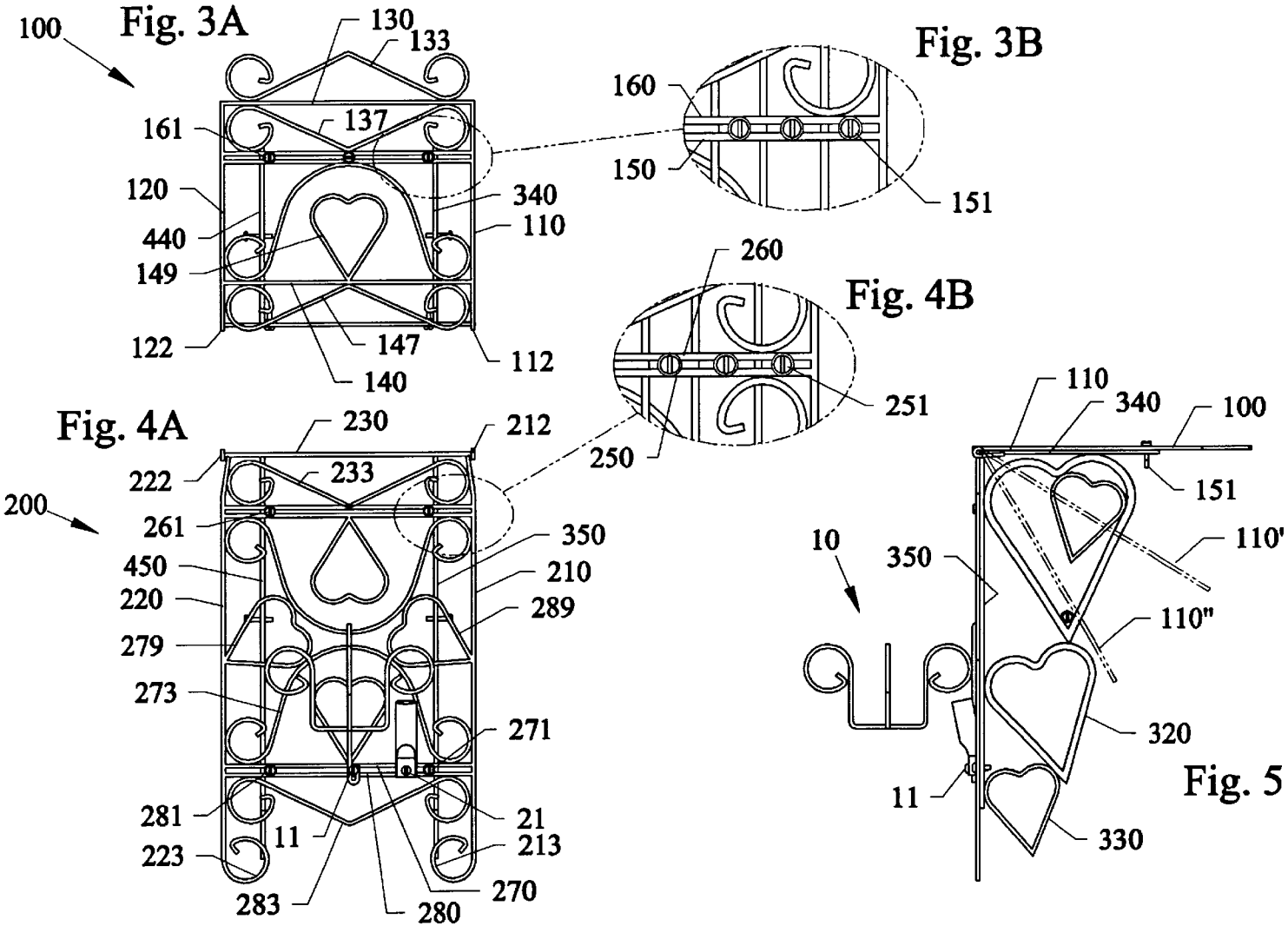
FIG. 3A is a top view of the upper frame member of FIG. 2 along arrow A.
FIG. 3B is an enlarged view of a portion of the upper frame member of FIG. 3A.
FIG. 4A is side view of the lower frame member of FIG. 2 along arrow B.
FIG. 4B is an enlarged view of a portion of the lower frame member of FIG. 4A.
FIG. 5 is a front view of the frame cover of FIG. 2 along arrow C.

FIG. 1 is a perspective view of a potholder 10 and flagpole holder 20 detached from the frame cover 1. FIG. 2 is a view of FIG. 1 with both the pot and flagpole holders 10, 20 attached to the frame cover 1. FIG. 3A is a top view of the upper frame member 100 of FIG. 2 along arrow A. FIG. 3B is an enlarged view of a portion of the upper frame member 100 of FIG. 3A. FIG. 4A is side view of the lower frame member 200 of FIG. 2 along arrow B. FIG. 4B is an enlarged view of a portion of the lower frame member 200 of FIG. 4A. FIG. 5 is a front view of the frame cover of FIG. 2 along arrow C showing side frame member 300.

Referring to FIGS. 1–5, frame cover 1 includes upper frame member 100 which functions as a top plate, and is formed from durable wire type metal strands such as cold rolled steel, and the like, that can be painted with a weather coating type paint for long wear. Upper frame member 100 can include four longitudinal strands 110, 120 130 and 140 that can be attached to one another by welding, soldering, and the like, that together form a rectangular type frame. A pair of narrowly separated parallel strands 150, 160 that have ends attached to external side strands 110, 120 form slide bars that allow fasteners 151, 161 such as non rustable bolts, screws, nuts, and the like, to be able to be rotated to abut against a monument headstone. The fasteners 151, 161, can be formed from plastic, nylon, and the like, and can include internal nuts, that can be connected to top strand 340 of side member 300, and top strand 440 of opposite side member 400, the function of which will be explained in more detail later. The upper frame member 100 can further include patterned shapes such as decorative curved designs 133, 137, 143, 147 and heart shapes 149 can be formed from pre-bending the metal type strands. Upper frame 100 can have a width of approximately 13 inches and a length of approximately 14 inches, and be sized to fit over the top of most headstones.

The upper frame member 100 is pivotally connected by a bent wire ends 112, 122 which form a hinge to protruding wire ends 212, 222 to lower frame member 200, which forms a back plate for the frame cover 1. Lower frame member 200 is formed from durable wire type metal strands such as cold rolled steel, and the like, that can be painted with a weather coating type paint for long wear. Lower frame member 200 can include three longitudinal strands 210, 220 230 and parallel strands 270, 280 that can be attached to one another by welding, soldering, and the like, that together form a rectangular type frame. A pair of narrowly separated parallel strands 250, 260 that have ends attached to external side strands 210, 220 form slide bars that allow fasteners 251, 261 such as non rustable bolts, screws, nuts, and the like, to be able to be rotated to abut against a monument headstone. The fasteners 251, 261, can be formed from plastic, nylon, and the like, and can include internal nuts, that effectively cause the lower frame member 200 to remain affixed to but physically separated from the monument itself. Another pair of narrowly separated parallel strands 270, 280 that have ends attached to external side strands 210, 220 form another set of slide bars allow additional fasteners 271, 281 similar to those previously described that can be connected to back strand 350 of side member 300, and back strand 450 of opposite side member 400, the function of which will be explained in more detail later. The lower frame member 200 can further include patterned shapes such as decorative curved designs 213, 223, 233, 237, 273, 283 and heart shapes 239, 279, 289 can be formed from pre-bending the metal type strands. Lower frame 200 can have a width of approximately 13 inches and a length of approximately 22 inches, and be sized to fit over the most of the side edge of many headstones. A decorative pot holder 10 that can have four upwardly protruding prongs 12, 14, 16, 18 each that can have decorative curved ends can be attached to the lower member by a fastener 11, such as a screw, and the like, and/or by a hook 15, that can hang from a bent strand 237. Additionally, a cylindrical type flagpole holder 20 having an open top end 22 can also be attached to the lower member 200 by fasteners 21, such as screws, and the like.

Two side frame members 300, 400 can be fastened to both the upper frame member 100 and the lower frame member 200. Each of the side frame members 300, 400 can include three sections a large upper portion 310, 410, that can be a wire type strand bent in the shape of a heart, a middle mid-size portion 320, 420, that can also be a wire type strand bent in the shape of a heart, smaller than the upper portion 310, 410, and a small bottom portion 330, 430 also shaped like a heart. Each of the portions 310, 320, 330 and 410, 420, 430 can be welded to one another and to respective top strand members 340, 440 and back strand members 350, 450, respectively. The top strand members 340, 440 can be adjustably moved relative to the upper member 100 by having fasteners 151, 161 that can slide within parallel strands 150, 160 so that the side frame members 300, 400 can adjustably fit about various thickness monument stones. Similarly, back strand members 350, 450 can adjustably moved relative to the lower frame member 200 by having fasteners 251, 261, 271, 281 that can slide within two sets of parallel strands 250, 260 and 270, 280. When the cover frame I is not being used and/or is being transported, side frame members 300, 400 can be detached by their respective fasteners from upper and lower frame members 100, 200, and upper frame member 100 can fold over lower frame member 200 as shown by the positions 110' and 110" shown in FIG. 5.

Figure 7:
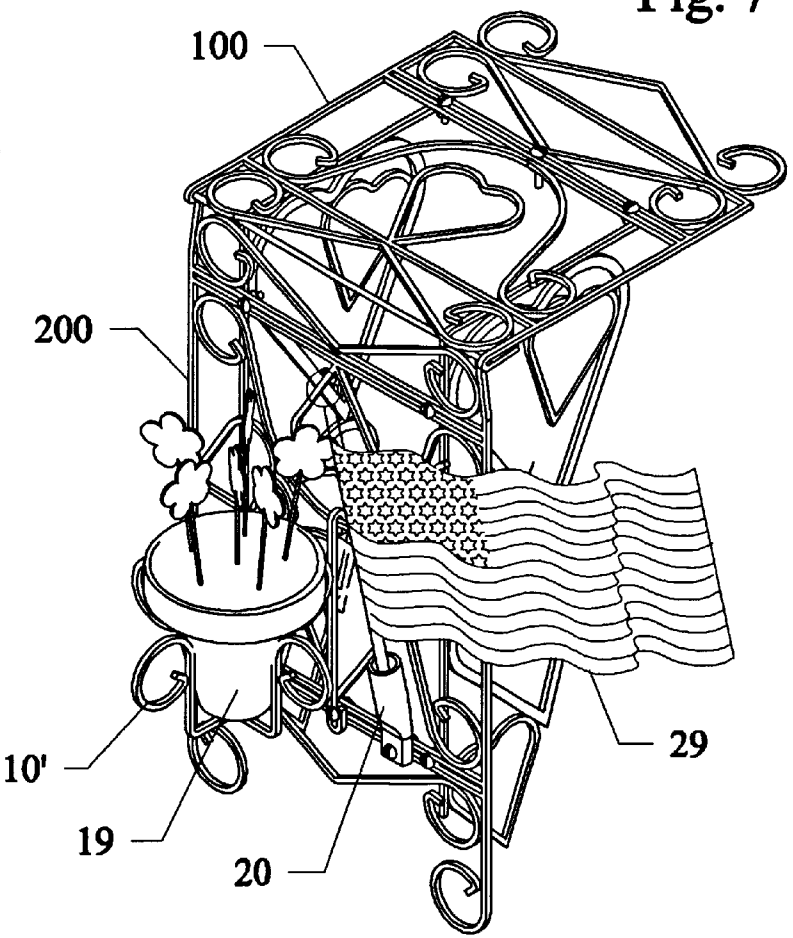
FIG. 7 is a view of FIG. 6 with the potholder and flagpole holder attached to the frame cover.
Figure 6:
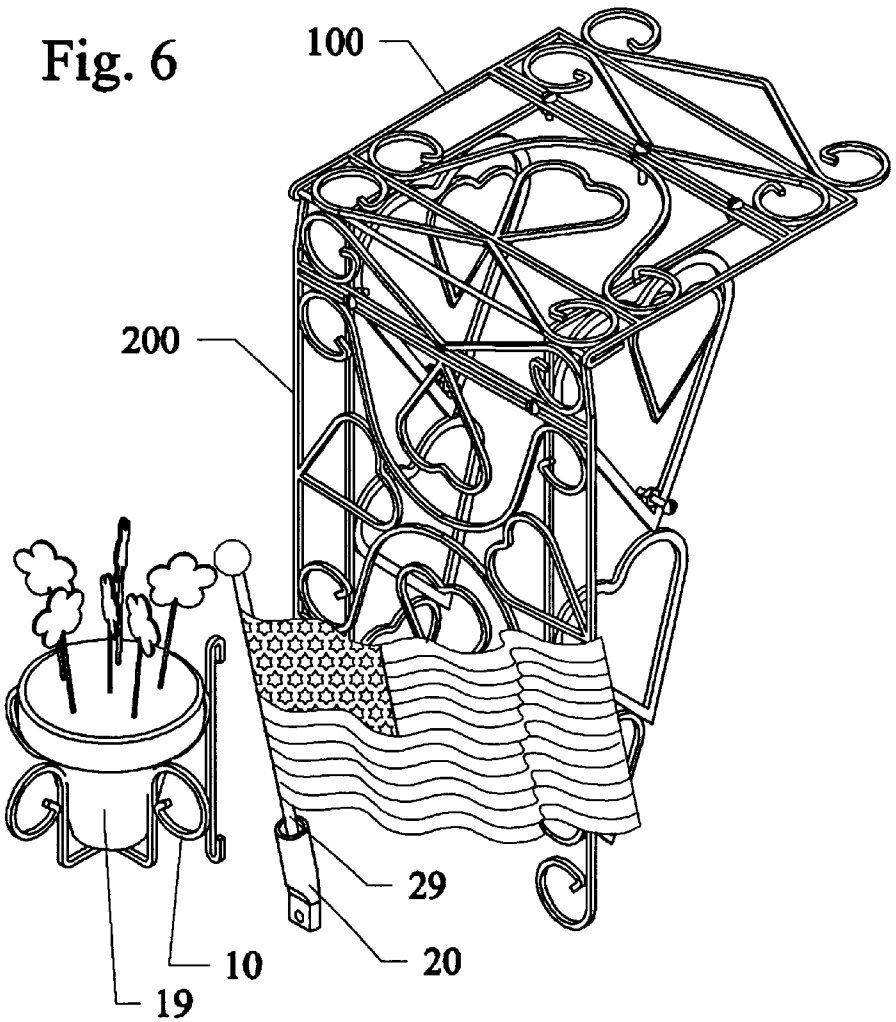
FIG. 6 is another view of FIG. 1 with a pot in the potholder and a flagpole in the flagpole holder.
Figure 8:
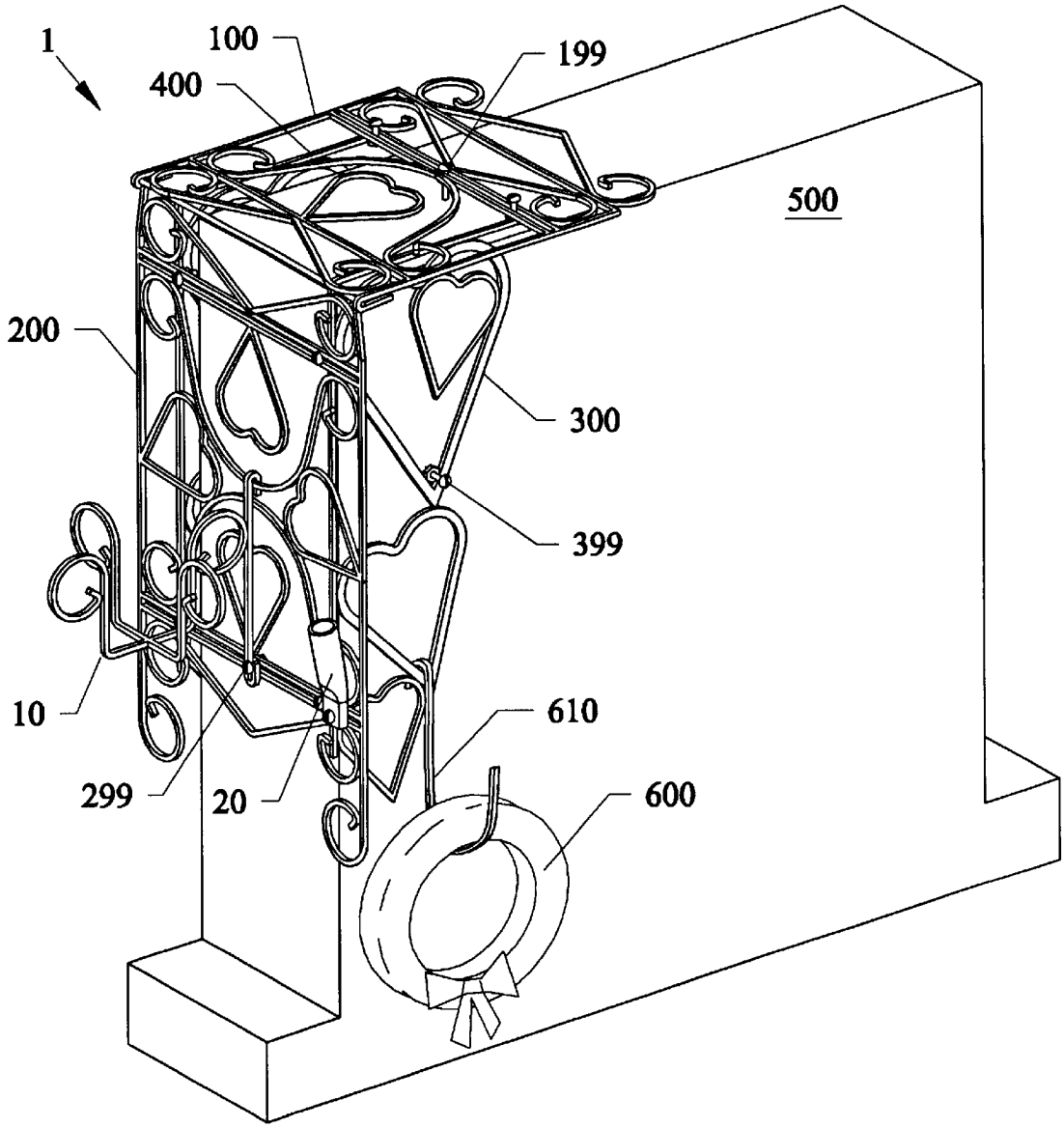

FIG. 6 is another view of FIG. 1 with a pot 19 in the potholder 10 and a flagpole 29 in the flagpole holder 20. FIG. 7 is a view of FIG. 6 with the potholder 10 and flagpole holder 20 attached to the (back) lower frame member 200 of the frame cover 1.

FIG. 7 shows the frame cover 1 of FIG. 2 affixed about an upper corner of a headstone 500, where nonmetallic bolts 199, 399, 299 can screw into respective upper, side and lower frame members 100, 300, 200 to both affix the cover frame 1 to the headstone 500 while keeping the cover frame 1 from touching the headstone 500. At a mininum two bolts 199, 299 can be used for leveling purposes and to keep the frame members 100, 200, 300 from touching the monument headstone 500. The bolts can be adjusted along slide bars formed around them. The bolt sizes 199, 299 can be one inch, one and half inch, and the like. An additional hook 610 can be affixed to one of the bent strands of the cover frame 1 in order to suspend a wreath 600 therefrom.

While the frame cover has been described as fitting about one upper corner of a headstone, more than one frame cover can be used where both upper corners of a headstone are effectively wrapped with respective frame covers.

Although the preferred embodiment is described as being formed from metal such as cold rolled steel, other types of materials such as but not limited to aluminum, plastic, and the like can be used.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A decorative frame cover for attachment to cemetery headstones, comprising in combination:

a headstone having a front face and a rear face, a first side edge, a top edge and a second side edge opposite the first side edge;

an upper substantially rectangular frame member being positioned to substantially rest parallel to a portion of the top edge of the headstone;

a lower substantially rectangular frame member, the lower substantially rectangular frame member being positioned to substantially rest parallel to a portion of one of the first side edge and the second side edge; and means for pivotally attaching the lower substantially rectangular frame member to the upper substantially rectangular frame member, wherein the upper substantially rectangular frame member and the lower substantially rectangular frame member pivotally wraps about one upper edge portion of the headstone where the top edge meets one of the first side edge and the second side edge of the headstone.

2. The decorative frame cover of claim 1, further comprising:

means for attaching the frame cover to the headstone.

3. The decorative frame cover of claim 2, wherein the attaching means includes:

a first bolt connected to the frame cover, and having an end that abuts against and does not penetrate a surface portion of the headstone, wherein rotating the first bolt affixes the frame cover to the headstone.

4. The decorative frame cover of claim 3, further comprising:

a second bolt connected to the frame cover, and having an end that abuts against and does not penetrate another surface portion of the headstone, wherein rotating the first bolt and the second bolt both affixes the frame cover to the headstone while forming a space that keeps the frame cover from touching against the headstone.

5. The decorative frame cover of claim 1, wherein at least one of the upper substantially rectangular frame member and the lower substantially rectangular frame member includes:

a decorative pattern formed from wire members.

6. The decorative frame cover of claim 5, wherein the pattern includes a heart shape.

7. The decorative frame cover of claim 1, further comprising:

a side frame member attached to both the upper substantially rectangular frame member and the lower substantially rectangular frame member, the side frame member covering a portion of one of the front face and the rear face of the headstone, wherein the upper substantially rectangular frame member and the lower substantially rectangular frame member being substantially perpendicular to one another.

8. The decorative frame cover of claim 1, further comprising:

a potholder for supporting at least one of a planter and a flower pot therein from the lower substantially rectangular frame member.

9. The decorative frame cover of claim 8, further comprising:

a hook for attaching and detaching the potholder from the lower substantially rectangular frame member.

10. The decorative frame cover of claim 1, further comprising:

a pole holder for supporting a flagpole therein from the lower substantially rectangular frame member.

11. The decorative frame cover of claim 10, further comprising:

means for attaching and detaching the pole holder from the lower substantially rectangular frame member.

12. The decorative frame cover of claim 1, further comprising:

a wreath; and a hook for attaching and detaching the wreath from the frame cover.

13. The decorative frame cover of claim 1, further comprising:

a hinge attached to both the upper frame member and the lower frame member, wherein the hinge allows the upper frame member to be perpendicular to the lower frame member and pivotally fold to where the upper frame member is substantially parallel to the lower frame member.

14. The decorative frame cover of claim 1, wherein the upper frame member and the lower frame member each are formed from wire members.

15. A corner frame cover for substantially wrapping about upper side edges of headstones, comprising in combination:

a headstone having a front face and a rear face, a first side edge, a top edge and a second side edge;

an upper substantially planar shaped frame member for substantially resting against a portion of the top edge of the headstone;

a lower substantially planar shaped frame member for substantially resting against a portion of one of the first side edge and the second side edge, of the headstone;

means for connecting the upper substantially planar shaped frame member to the lower substantially planar shaped frame member wherein the frame cover substantially wraps about one upper corner edge of the headstone where the top edge meets one of the first side edge and the second side edge, of the headstone;

means for fixably attaching the corner frame cover to the headstone; and means for supporting an item from the lower substantially planar shaped frame member, wherein the item is selected from at least one of: a wreath, a flagpole, and a pot.

16. The corner frame cover of claim 15, further comprising at least one of:

a removable holder for supporting the item, and a hook for allowing the holder to be attached and detached from the lower substantially planar shaped frame member.

17. The corner frame cover of claim 15, wherein the connecting means includes:

a hinge for allowing the upper substantially planar shaped frame member to pivotally attach to the lower substantially planar shaped frame member at the one upper corner edge of the headstone where the top edge meets one of the first side edge and the second side edge, of the headstone.

18. A method of wrapping a decorative frame covers about headstones, comprising the steps of:

providing a headstone having a front face, a rear face, a top edge, a first side edge and a second side edge;

pivotally attaching an upper rectangular planar frame member to a lower rectangular planar member;

positioning the upper rectangular planar frame member to rest against a portion of the top edge of a headstone;

positioning the lower rectangular planar frame member to rest against a portion of one of the first side edge and the second side edge, of the headstone, wherein the upper rectangular frame member and the lower rectangular planar member substantially wraps about only one of an upper corner edge of the headstone where the top edge meets one of the first side edge and the second side edge, of the headstone; and attaching item holders to the lower rectangular planar frame member; and supporting at least one of a pot holder, a flagpole holder and a wreath solely from portions of the lower rectangular frame member.

19. The method of claim 18, wherein the step of pivotally attaching further includes the step of:

pivotally attaching the lower rectangular planar frame member to the upper rectangular frame member with a hinge.

* * * * *